United States Patent [19]

Prewo et al.

[11] Patent Number: 4,911,990

[45] Date of Patent: Mar. 27, 1990

[54] MICROSTRUCTURALLY TOUGHENED METALLIC ARTICLE AND METHOD OF MAKING SAME

[75] Inventors: Karl M. Prewo, Vernon; Vincent C. Nardone, Meriden; James R. Strife, South Windsor, all of Conn.

[73] Assignee: United Technologies Corporation, Hartford, Conn.

[21] Appl. No.: 152,773

[22] Filed: Feb. 5, 1988

[51] Int. Cl.[4] ..... B22F 7/04

[52] U.S. Cl. ..... 428/554; 419/23; 419/28; 419/49; 419/67; 428/557; 428/558; 428/614

[58] Field of Search ..... 428/557, 559, 558, 614; 419/8, 67, 49, 28, 23

[56] References Cited

U.S. PATENT DOCUMENTS 3,264,697 8/1966 Price et al. ..... 428/614
3,945,555 3/1976 Schmidt ..... 428/614

OTHER PUBLICATIONS

D. W. Kum, T. Oyama, J. Wadsworth and O. D. Sherby, *The Impact Properties of Laminated Composites Containing Ultrahigh Carbon (UHC) Steels*, J. Mech. Phys., vol. 31, No. 2, pp. 173–186, 1983.

*Primary Examiner*—Stephen J. Lechert, Jr.
*Attorney, Agent, or Firm*—Harry J. Gwinnell; Charles E. Sohl

[57] ABSTRACT

A microstructurally toughened metallic article is disclosed. The article includes discrete metal regions which are enclosed within and separated from each other by a network of metal. The regions are bonded to the network to form stable interfacial boundaries. The article exhibits high impact resistance. The process for making the article is also disclosed. The process includes positioning a plurality of structural elements within a container to define one or more void spaces within the container, introducing a quantity of metallic particles into the void spaces, and then consolidating the container, structural elements, and particles to form the microstructurally toughened article.

5 Claims, 1 Drawing Sheet

FIG. 1
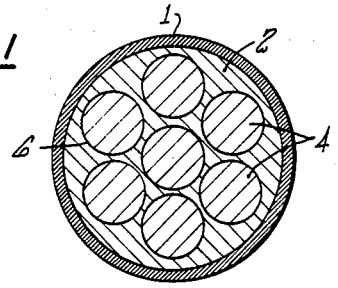
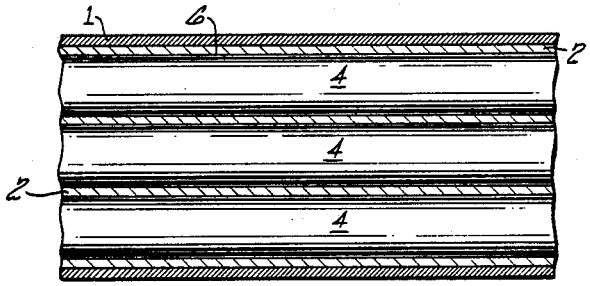
FIG. 2
FIG. 3
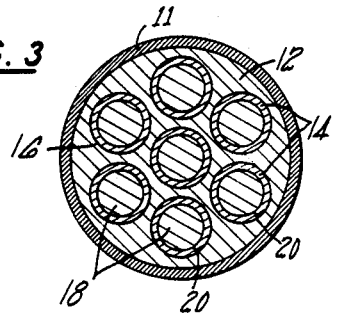
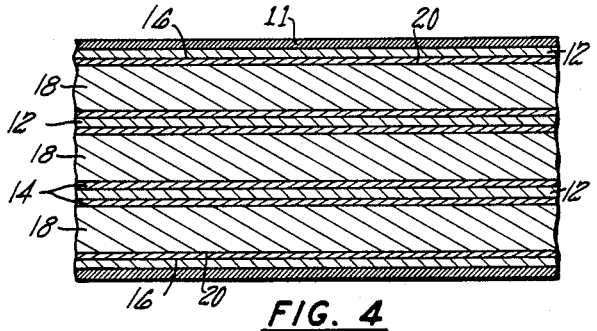
FIG. 4

MICROSTRUCTURALLY TOUGHENED METALLIC ARTICLE AND METHOD OF MAKING SAME

TECHNICAL FIELD

This invention pertains to metallic materials and articles made therefrom.

BACKGROUND ART

The fracture behavior of a metallic material is a key factor in determining the suitability of the material for use in structural applications.

Impact testing is a traditional method for studying the fracture behavior of materials. Typically, an impact test specimen of the material is supported in the fixture and struck wit a heavy pendulum to fracture the specimen. The force necessary to fracture the specimen is a measure of the impact absorbing ability of the material. A notch may be introduced into the surface of the impact specimen to concentrate the impact stress and thus increase the severity of the impact test.

Many conventional metals exhibit high impact strength in the unnotched condition but exhibit very severe degradation in impact absorbing ability in the notched condition and may accordingly be characterized as notch-sensitive. Poor impact resistance, and particularly notch sensitivity translates directly into a structural reliability problem and poses a formidable obstacle to the use of an otherwise suitable material in load bearing applications.

What is needed in the art is a metallic article which exhibits high impact strength in both the notched and unnotched condition.

DISCLOSURE OF INVENTION

A metallic article which exhibits high impact resistance is disclosed. The article comprises a first metallic region and a plurality of discrete metallic regions. Each of the regions substantially continuously extends along the first axis of the article from a first end of the article to a second end of the article. The first metallic region forms a two-dimensional network perpendicular to the first axis of the article to separate each discrete metallic region from each of the other discrete metallic regions. Each of the second metallic regions is bonded to the first metallic region to form a stable interfacial boundary between each second metallic region and the first metallic region. At least two of the second metallic regions are enclosed in all directions perpendicular to the first axis of the article.

A process for making a metallic article is also disclosed. The process comprises providing a metallic container, positioning a plurality of longitudinally extending metallic tubes or metallic rods within the metallic container to define one or more longitudinally extending void spaces within the container, introducing a quantity of metallic particles into each of the void spaces and consolidating the metallic container, the structural elements and the metallic particles to form the metallic article.

The foregoing and other features and advantages of the present invention will become more apparent from the following description and accompanying drawings.

BRIEF DESCRIPTION OF DRAWINGS

FIG. 1 shows a schematic cross-sectional view of a metallic rod of the present invention.

FIG. 2 shows a schematic longitudinal sectional view of the metallic rod of FIG. 1.

FIG. 3 shows a schematic cross-sectional view of a second metallic rod of the present invention.

FIG. 4 shows a schematic longitudinal view of the metallic rod of FIG. 3.

BEST MODE FOR CARRYING OUT THE INVENTION

The metallic article of the present invention exhibits a complex microstructure. The microstructure of a metallic rod of the present invention is shown in FIGS. 1 and 2.

FIG. 1 shows a cross-sectional view of a metallic rod of the present invention. The rod is enclosed in a metallic sheath 1. A plurality of second metallic regions 4 are embedded in a first metallic region 2. The first metallic region 2 forms a two-dimensional network which separates each of a plurality of discrete second metallic regions 4 from each of the other discrete second metallic regions 4. Each of the second metallic regions 4 are completely, or at least, substantially enclosed in all directions in the cross-sectional plane by the first metallic region 2. The composition of the respective regions is discussed in greater detail below.

While a composite article of the present invention may comprise as few as two second metallic regions, improved performance may be obtained by increasing the number of second metallic regions. It is preferred that an article of the present invention comprise five or more second metallic regions and it is particularly preferred hat an article of the present invention comprise ten or more second metallic regions.

Each of the regions is contiguous with the other regions and the contiguous regions are interconnected to form a coherent article. Each of the second metallic regions 4 is bonded to the first metallic region to form a stable interfacial boundary 6 between each second metallic 4 region and the first metallic region 2. Each interfacial boundary may be characterized by an interfacial shear strength. The interfacial shear strength of each interfacial boundary is sufficiently high so that load may be transferred between the adjoining regions. It is preferred that each interfacial boundary be stable within the temperature range of intended use, and it is particularly preferred that each interfacial boundary be sharply defined. A stable interfacial boundary is one which does not change over time. A sharply defined interfacial boundary is one which provides an abrupt, rather than a gradual, transition between adjoining regions. A stable, sharply defined interface between adjoining regions may be obtained if the composition of the adjoining regions is chosen so that only limited interdiffusion occurs between the adjoining regions at temperatures up to and including the intended use temperature.

In the preferred embodiment shown in FIG. 1, the discrete second metallic regions 4 have a circular cross-sectional shape. The discrete second metallic regions 4 may have cross-sectional shapes other than a circular shape, and each of the discrete second metallic regions may have a cross-sectional shape that is different from the other discrete second metallic regions. For example, the second metallic regions may have ovoid, square, rectangular or other noncircular cross-sectional shapes and the first metallic region may have any shape complimentary to the shape of the second metallic regions.

A metallic article of the present invention extends along a first axis from a first end to a second end. FIG. 2 shows a longitudinal sectional view of tee metallic rod shown in FIG. 1. The first metallic region 2 extends along the longitudinal axis of the rod, the second metallic regions 4 are each oriented along the longitudinal axis of the rod. While it is preferred that each region extend continuously from the first end of the article to the second end of the article, each region may extend substantially continuously from the first end of the article to the second end of the article. A region which extends substantially continuously from the first end of the article to the second end of the article may be interrupted by discontinuities as long as the discontinuities do not adversely affect the tensile strength, elastic modulus and impact resistance of the article. Each of the discrete second metallic regions 4 is defined by a stable first interfacial boundary 6 between the first metallic region 2 and each discrete second metallic region 4.

FIG. 3 shows a cross-sectional view of a second metallic rod of the present invention. The rod is enclosed in a metallic sheath 11. A plurality of second metallic regions 14 are each embedded in a first metallic region 12. A first metallic region 20 forms a two-dimensional network which separates each of a plurality of second metallic regions 14 from each of the other second metallic regions 14. A plurality of discrete third metallic regions 18 are each enclosed in all directions in the cross-sectional plane by one discrete second metallic region 14 each. The composition of the respective regions is discussed in greater detail below.

Each of the regions is contiguous with the other regions and the contiguous regions are interconnected to form a coherent article. Each of the regions adjoins other regions of the article an is bonded to the regions which it adjoins to form a stable interfacial boundary between the adjoining regions. The interfacial shear strength of each interfacial boundary is sufficiently high so that load may be transferred between the adjoining regions. It is preferred that each interfacial boundary be stable within the temperature range of intended use, and it is particularly preferred that each interfacial boundary be sharply defined. Each of the second metallic regions 14 is defined by a stable interfacial boundary 16 between the first metallic region 12 and each discrete second metallic region 14. Each of the discrete third metallic regions 18 is defined by a stable interfacial boundary 20 between the third metallic region 18 and the second metallic region 14 within which the third metallic region 18 is enclosed.

In the preferred embodiment shown in FIG. 3, the discrete second metallic regions 14 are each ring shaped, and the discrete third metallic regions 18 each have a circular cross-sectional shape. The second metallic regions may have cross-sectional shapes other than the ring shape, and each of the second metallic regions may have a cross-sectional shape that is different from the other second metallic regions. For example, the second metallic regions may have ovoid, square, rectangular or other noncircular cross-sectional shapes and the first metallic region and the third metallic regions may have any shape complimentary to the shape of the second metallic regions.

A metallic article of the present invention extends along a first axis from a first end to a second end. FIG. 4 shows a longitudinal sectional view of the metallic rod shown in FIG. 3. The first metallic region 12, the second metallic regions 14, and the third reinforced regions 18 each extend along the longitudinal axis of the rod. While it is preferred that each region extend continuously from the first end of the article to the second end of the article, each region may extend substantially continuously from the first end of the article to the second end of the article. Each of the second metallic regions 14 is defined by a stable first interfacial boundary 16 between the first metallic region 12 and each second metallic region 14. Each of the third metallic regions 18 is defined by a stable second interfacial boundary 20 between the third metallic region 18 and the second metallic region 14 within which it is enclosed.

In each of the preferred embodiments shown in the FIGS., each of a plurality of second metallic regions is enclosed in all directions in the cross-sectional plane. It is not necessary that every second metallic region be completely enclosed by a first metallic region. For example, a bar machined from the rod shown in FIGS. 1 and 2 and having a rectangular cross sectional shape and having at least two of the second metallic regions completely enclosed is another embodiment of the present invention. While it is sufficient that two or more of the second metallic regions are enclosed, improved performance may be obtained by increasing the number of enclosed second metallic regions, and it is preferred that five or more second metallic regions be enclosed by a first metallic region.

Similarly, with regard to embodiments which are analogous to that shown in FIGS. 3 and 4 while it is not necessary that every third metallic region be completely enclosed by a second metallic region, improved performance may be obtained by increasing the number of enclosed third metallic regions, and it is preferred that five or more third metallic regions be completely enclosed by second metallic regions.

The process of the present invention is a preferred method for fabricating the article of the present invention. Briefly, a plurality of metallic tubes or metallic rods are each positioned within a metallic container so that the container and structural elements define a void space or a plurality of longitudinally extending void spaces within the container. A quantity of metallic particles is introduced into the void spaces. The container, structural elements and particles are then consolidated by exposure to elevated pressure at an elevated temperature to form a metallic article of the present invention.

A metallic container may be any metallic container having continuous inner surface which extends along a longitudinal axis from a closed end of the container to an open end of the container to define an internal void space. The void space is characterized by a depth which corresponds to the distance between the closed end of the container and the open end of the container, and a cross-sectional dimension, for example, a diameter, which corresponds to a characteristic cross-sectional distance. It is preferred that the depth of the void space be very large relative to the cross-sectional dimension of the void space. For example, a right circular cylindrical can is suitable as the container as are similar containers having square, rectangular or other cross-sectional shapes.

The structural elements each extends longitudinally from a first end of the structural element to a second end of the structural element and may have any cross-sectional shape. Each of the structural elements may be characterized by a length, corresponding to the distance between the first end of the structural element and the second end of the structural element and by a characteristic cross-sectional dimension, for example a diameter. It is preferred that the length of the structural elements be very large relative to the characteristic cross-sectional dimension of the structural elements. The structural elements may comprise, for example, right circular cylindrical tubes, right circular cylindrical mechanical rods, as well as metallic tubes or metallic rods having square, rectangular or other cross-sectional shapes.

The structural elements are positioned within the metallic container so that the metallic container and the structural elements define one or more void spaces which extend along the longitudinal axis of the metallic container For a given article, the cross-sectional dimensions of the can and of the structural elements are chosen so that a plurality of structural elements may be positioned parallel to each other within the metallic container and the longitudinal axis of each structural element oriented along the longitudinal axis of the metallic container. The structural elements are packed tightly enough to remain roughly parallel to each other, but not tightly enough to prohibit metal particles from flowing between the elements during subsequent processing steps. While it is preferred that all structural elements be of the same composition, combinations of the different types of structural elements may be used. It is preferred that the structural elements are of substantially equal length and that the length of each structural element is slightly less than the depth of the void defined by the metallic container. For example, an array of parallel tubes or an array of parallel rods may be positioned within the metallic container.

A quantity of metallic particles is introduced into the void spaces defined by the container and the structural elements. It is preferred that a sufficient quantity of particles be introduced to substantially fill all the void spaces within the metallic container. Preferably the metallic container and structural element assembly is vibrated during the introduction of the particles to permit close packing of the particles. Once the void spaces of the metallic container and structural element assembly are filled, it is preferred that the filled assembly is vacuum degassed at an elevated temperature. The assembly is then sealed by crimping the open end of the metallic container.

The metallic container containing the structural elements and the particles is consolidated by exposure to elevated pressure at an elevated temperature to form a coherent article. Conventional consolidation processes such as hot pressing, hot isostatic pressing followed by extrusion, or direct extrusion consolidation may be used. The particular consolidation processing parameters depend on the composition of the particular article and will be familiar to those skilled in the art.

The consolidated article is suitable as a feed stock for subsequent working operations and may be formed into complex shapes by such conventional metal working operations as forging or machining.

The metallic powder of the process of the present invention is consolidated to form the first metallic region and third metallic regions of the article of the present invention. The structural elements of the process of the present invention form the second metallic regions of the article of the present invention. The composition and relative volume of the container, the structural elements, and the metallic particles of the process are chosen to provide an article of a particular composition.

The metallic container, structural elements, and metallic particles of the process may each comprise the same metal alloy. Similarly, the metallic regions of the article may each comprise the same metal alloy. Suitable metal alloys are those which can be formed at elevated temperatures, using conventional metal working techniques. Suitable metal alloys include, for example, titanium and aluminum. If all the regions of the article comprise the same metal alloy, it is preferred that the interfacial boundary include an interfacial layer. Such an interfacial layer may comprise, for example, an oxide of the metal alloy of which the regions are comprised. Such an oxide layer may be obtained if the structural elements of the process of the present invention include an oxide surface layer.

The metallic regions of the article may comprise different metal alloys. If the metal regions comprise different metal alloys, suitable metal alloys for the second metallic regions are metal alloys which are tough, ductile and workable within the same temperature range as the metal alloy of the first metallic region and of the third metallic regions. Suitable metal alloys include, for example, alloys of titanium and aluminum. Suitable metal alloys for the first metallic region and third metallic regions are brittle alloys whose low toughness and impact resistance limit their application in load bearing structures. Particularly suitable metal alloys include, for example, such "intermetallics" as nickel aluminide, niobium aluminide, or titanium aluminide.

EXAMPLE 1

A 6061 Al can having an O.D. of 2.5 inches wall thickness of 0.12 inches was filled with 61 cylindrical 6061 Al tubes, each having an O.D. of 0.25 inches and a wall thickness of 0.065 inches. The void spaces were filled with −325 mesh 6061 Al powder. The can, tubes and powders were vacuum degassed for 30 minutes at 950° F., then subjected to hot isostatic pressing at 900° F. and 15000 psi for 2 hours and finally consolidated by extrusion at 850° F. through a 0.5 inch O.D. cylindrical die.

Specimens were machined from the extruded rod and subjected to notched Charpy impact testing. The results are given in Table I along with comparative data for conventional 6061 Al-T6.

TABLE I

| Material | | Energy Dissipated (ft-lb) |
|---|---|---|
| Conventional 6061 Al-T6 | | 6.7 |
| Microstructurally toughened 6061 Al-T | Specimen 1 | >37.9 |
| | 2 | 54.4 |
| | 3 | 56.7 |

EXAMPLE 2

A titanium aluminum-vanadium alloy (Ti-6Al-4V) can is filled with cylindrical Ti-6Al-4V tubes to define a plurality of longitudinally extending void spaces within the can. The void spaces are filled with −325 mesh Ti-6Al-4V powder. The can, tube powder assembly is vacuum degassed, crimped closed and consolidated by extrusion through a cylindrical die to form a metallic rod.

EXAMPLE 3

A stainless steel can is filled with cylindrical stainless steel tubes. The interstitial void spaces are filled with −325 mesh nickel aluminide powder. The can, tube and powder assembly is vacuum degassed, crimped closed and consolidated by extrusion through cylindrical die to form a metallic rod.

While not wishing to be bound by any particular theory, there appears to be a microstructural basis for the improved impact resistance exhibited by the metallic article of the present invention. The basis for the improved performance of the present invention appears to be the presence of internal interfaces within the article. The tip of a propagating crack is blunted upon encountering such an internal interface, reducing the stress and strain concentration in the vicinity of the crack tip, thus reducing the driving force for crack propagation and material failure. The article of the present invention comprises a plurality of metallic regions which are compartmentalized within a metallic network. A crack propagating in any direction perpendicular to the longitudinal axis of the article eventually encounters an interfacial boundary. The tip of the propagating crack is blunted upon encountering the internal interface and the driving force for a crack propagation is reduced. In articles of the present invention in which the regions comprise different metal alloys, the alternating brittle and ductile regions provide an additional crack arresting mechanism.

The metallic article of the present invention may be worked using conventional metal working techniques such as extrusion or forging, making large scale production and the production of complex shapes possible.

Although this invention has been shown and described with respect to detailed embodiments thereof, it will be understood by those skilled in the art that various changes in form and detail thereof may be made without departing from the spirit and scope of the claimed invention.

I claim:

1. A metallic article, said article extending along a first axis from a first end to a second end, comprising:

a first metallic region, said first metallic region substantially continuously extending along the first axis from the first end to the second end of the article, said first metallic region having been formed by the consolidation of metallic particles, a plurality of discrete second metallic regions, each substantially continuously extending along the first axis from the first end to the second end of the article, wherein the first metallic region forms a two-dimensional network perpendicular to the first axis to separate each second metallic region from other second metallic regions, each of the second metallic regions is bonded to the first metallic region to form a stable interfacial boundary between each second metallic region and the first metallic region, and at least two of the second metallic regions are substantially enclosed in all directions perpendicular to the first axis, said article exhibiting high impact strength perpendicular to the first axis.

2. The metallic article of claim 1 additionally comprising one or more discrete third metallic regions, said third metallic region having been formed by the consolidation of metallic particles each embedded within a second metallic region so that at least one third metallic region is enclosed in all directions perpendicular to the first axis by the second metallic region within which it is embedded, each third reinforced region substantially continuously extends from the first end of the article to the second end of the article, and each third metallic region is defined by a stable second interfacial boundary between the third metallic region and the second metallic region within which the third metallic region is enclosed.

3. The metallic article of claim 2 wherein the first metallic region comprises an aluminum alloy, each of the second metallic regions comprises the aluminum alloy and each of the third metallic regions comprises the aluminum alloy.

4. A process for making a metallic article comprising:

providing a metallic container, said metallic container having a substantially continuous inner surface which extends along a first axis from an open end of the container to a closed end of the container, positioning a plurality of longitudinally extending structural elements along the first axis within the metallic container so that the structural elements and the container define one or more void spaces which extend along the first axis of the container, each of said longitudinally extending elements being selected from the group consisting of metallic tubes and metallic rods, and introducing a quantity of metallic particles into each of the void spaces to substantially fill each of the void spaces, and consolidating the container, the structural elements, and the metallic particles at elevated temperature and pressure to form the metallic article.

5. A metallic article made by the process of claim 4.

* * * * *

UNITED STATES PATENT AND TRADEMARK OFFICE

CERTIFICATE OF CORRECTION

PATENT NO. : 4,911,990

DATED : March 27, 1990

INVENTOR(S) : Karl M. Prewo et. al.

It is certified that error appears in the above-identified patent and that said Letters Patent is hereby corrected as shown below:

Col. 1, line 18, "wit" should read --with--

Col. 1, line 53, after "are" insert --substantially--

Col. 2, line 36, "hat" should read --that--

Col. 3, line 5, "tee" should read --the--

Col. 3, line 26, "20" should read --2--

Col. 3, line 37, "an" should read --and--

Col. 5, line 16, after "container" insert --.--

Col. 6, line 35, after "inches" insert --and a--

Col. 6, line 65, after "tube" insert --and--

Signed and Sealed this

Seventeenth Day of March, 1992

*Attest:*

HARRY F. MANBECK, JR.

*Attesting Officer*

*Commissioner of Patents and Trademarks*